US007121169B1

(12) United States Patent
Larson

(10) Patent No.: US 7,121,169 B1
(45) Date of Patent: Oct. 17, 2006

(54) RATCHET HEAD

(75) Inventor: John Andrew Larson, Chicago, IL (US)

(73) Assignee: Precision Instruments, Inc., Des Plaines, IL (US)

( * ) Notice: Subject to any disclaimer, the term of this patent is extended or adjusted under 35 U.S.C. 154(b) by 73 days.

(21) Appl. No.: 10/757,659

(22) Filed: Jan. 14, 2004

Related U.S. Application Data

(60) Provisional application No. 60/439,865, filed on Jan. 14, 2003.

(51) Int. Cl.
*B25B 13/46* (2006.01)

(52) U.S. Cl. ..... 81/63; 81/58.1

(58) Field of Classification Search ..... 81/58.4, 81/58.1, 59.1–63.2
See application file for complete search history.

(56) References Cited

U.S. PATENT DOCUMENTS

| | | | | | |
|---|---|---|---|---|---|
| 3,019,682 | A | * | 2/1962 | Hare | 81/63.2 |
| 3,733,936 | A | * | 5/1973 | Flynn | 81/58.1 |
| 4,300,143 | A | | 11/1981 | Bell et al. | |
| 4,407,175 | A | | 10/1983 | Graham | |
| 4,480,510 | A | | 11/1984 | Aparicio, Jr. et al. | |
| 4,589,307 | A | | 5/1986 | Parker | |
| 4,735,120 | A | | 4/1988 | Beugelsdyk | |
| 4,903,554 | A | | 2/1990 | Colvin | |
| 5,129,293 | A | | 7/1992 | Larson et al. | |
| 5,157,994 | A | * | 10/1992 | Krivec | 81/63.2 |
| 5,626,061 | A | | 5/1997 | Whitley | |
| 5,761,972 | A | | 6/1998 | Sanders | |
| 5,957,009 | A | | 9/1999 | McCann | |
| 6,044,731 | A | * | 4/2000 | Hsieh | 81/63.2 |
| 6,109,140 | A | | 8/2000 | Roberts et al. | |
| 6,134,991 | A | | 10/2000 | Chaconas | |
| 6,164,167 | A | | 12/2000 | Chen | |
| 6,205,890 | B1 | | 3/2001 | Roberts et al. | |
| 6,276,239 | B1 | | 8/2001 | Albertson | |
| 6,314,839 | B1 | | 11/2001 | Carter | |
| 6,457,386 | B1 | | 10/2002 | Chiang | |

* cited by examiner

*Primary Examiner*—Hadi Shakeri
(74) *Attorney, Agent, or Firm*—Gardner Carton & Douglas LLP

(57) ABSTRACT

A ratchet useful for wrenches is provided having a pawl and a main gear that reside in a case, wherein the pawl is biased to engage teeth of the main gear to permit rotation in a selected direction. According to an aspect of the invention, a biasing mechanism is housed within the pawl and acts outwardly from the pawl against one or more ramped surfaces formed in the case, thereby biasing the pawl rotationally. For example, the biasing mechanism may be a coil spring housed within a bore extending through the pawl, aligned parallel to an axis of rotation of the pawl. The spring is compressed between two ball bearings, urging the ball bearings axially outwardly against the ramped surfaces. The ramped surfaces are shaped so that a component of the force of the ball bearings creates a rotational moment on the pawl.

12 Claims, 9 Drawing Sheets

RATCHET HEAD

CROSS-REFERENCE TO RELATED APPLICATION

This is a nonprovisional application claiming priority to U.S. provisional application No. 60/439,865, filed Jan. 14, 2003, incorporated herein by reference in its entirety.

FIELD OF THE INVENTION

This invention generally relates to ratchet mechanisms and more particularly relates to a ratchet for use with hand tools such as torque wrenches and socket wrenches.

BACKGROUND OF THE INVENTION

Ratchet wrenches are well known as hand tools. Ratchet wrenches typically have mechanisms that allow the action of the wrench to be reversed so that the wrench can be used for both tightening and loosening screws, nuts, bolts and the like. A common style of reversible ratchet wrench has a driving head mounted to a handle. Mounted within the head is a toothed ratchet wheel that includes a square drive projection to which sockets may be attached. It is known to provide a pawl pivotally mounted within the head in a manner, which allows the pawl selectively to contact the toothed portion of the ratchet wheel. In reversing ratchet wrenches, the pawl is switchable between two positions to be engageable against the teeth of the ratchet wheel for selectively permitting clockwise or counterclockwise rotation of the drive member. In each of the two positions, in the direction opposite the permitted direction, rotational movement is not permitted and the ratchet wheel is in a locked position, allowing applied forces to create a torque.

In a conventional ratchet using a pawl, it is well known to use a coil spring mounted in the driving head or handle of the wrench. The spring is in compression to force a contact ball against an exterior surface of the pawl. Such a conventional structure includes a bore that is drilled into the driving head in order to house the spring and contact ball. So that the spring force is properly directed against the pawl, the bore extends from a cavity in the head radially away from the pawl. Moreover, the pawl must have a specially contoured external surface such that radial spring force imparts a rotational moment to the pawl. Unfortunately, this conventional structure presents manufacturing difficulties that result in costly labor and special equipment. For example, the bore is difficult to drill from the confines of the cavity, and the complex contour of the exterior surface of the pawl requires a machining step using special equipment. Moreover, the bore effectively removes material from a critical stress point where the wrench handle meets the head.

BRIEF SUMMARY OF THE INVENTION

A ratchet mechanism is provided, such as a ratchet mechanism for a wrench. According to an aspect of the invention, the ratchet mechanism includes a unique pawl biasing mechanism housed within the pawl. The biasing mechanism acts against a shaped surface of the case in order to rotationally bias the pawl. In various embodiments, the ratchet mechanism may be provided in a unidirectional embodiment or in a selectively reversible, bi-directional embodiment. The ratchet mechanism may be used in a wrench or wrench head, as well as in other applications that utilize ratchet structures.

For example, in an embodiment, a ratchet mechanism is provided comprising a case having a first cavity and a second cavity, wherein the first cavity is contiguous to the second cavity and the second cavity having at least a first ramped surface. The ratchet mechanism includes a main gear that rotatably resides in the first cavity, wherein the main gear has a circular gear portion and a drive portion that extends from the center of the gear portion, the gear portion having a plurality of teeth. The ratchet mechanism also includes a pawl that rotatably resides in the second cavity, wherein the pawl includes a pawl body shaped to have at least a first catch portion. The pawl is rotatably movable about a pawl axis to at least a first engaged position wherein the first catch portion of the pawl engages at least one of the teeth of the gear portion to prevent the gear portion from rotating in a first direction. The pawl is rotatable away from the engaged position to permit rotation of the gear portion in a second direction opposite the first direction. Furthermore, the ratchet mechanism includes a biasing mechanism carried by the pawl. The biasing mechanism has at least one contact urged toward the ramped surface, wherein the contact is movable along the first ramped surface to thereby rotationally bias the pawl toward the first engaged position.

In an embodiment, the pawl includes a transverse bore shaped to contain the biasing mechanism. For example, the biasing mechanism may include a coil spring and upper and lower contact balls. The coil spring is held in compression between the upper and lower contact balls, which respectively contact against adjacent floor and ceiling surfaces of the cavity that houses the pawl. Advantageously, the contact balls may be standard ball bearings.

It has been found that an advantageous configuration is to provide the bore with an alignment that is generally parallel to the pawl axis. The bore is offset from the pawl axis in order to create a desired moment on the pawl. The pawl axis may be parallel to the main gear axis.

The ramped surface may be formed in the case at the floor or ceiling of the cavity, or both at the floor and ceiling. Moreover, the ramped surface may be recessed into the case or alternatively project upwardly.

In an embodiment, at least a portion of the pawl has a planar top surface, a planar bottom surface, and a generally cylindrical sidewall extending between the planar top and bottom surfaces. The top and bottom surfaces of the pawl are preferably perpendicular to the pawl axis on which the pawl rotates.

In an embodiment wherein the pawl is configured for unidirectional ratchet operation, the pawl may have a generally crescent-shaped concave surface configured for sliding contact on the main gear when the pawl is deflected to a maximum angle away from an engaged or locked position with respect to the main gear. Such a feature advantageously prevents the biasing mechanism from inadvertently moving beyond the ramped surface (which could cause the pawl to become stuck). In an embodiment, the concave surface has a radius about equal to an outermost radius of the gear portion.

In an embodiment, the second cavity that contains the pawl includes a generally planar floor surface and a generally planar ceiling surface, the floor and ceiling surfaces being positioned generally adjacent the top and bottom surfaces of the pawl, respectively. In a particular embodiment, the planar and cylindrical surfaces of the pawl ride on complementarily shaped floor, ceiling and cylindrical sidewall surfaces of the case as bearing surfaces to guide the rotation and position of the pawl. Such a configuration advantageously avoids a need for an axle to operate as a bearing structure for the pawl.

In an embodiment, the biasing mechanism includes two contacts, such as contact balls, wherein one of the contacts is urged toward the at least one ramped surface located on the floor surface, and wherein the other contact is urged toward the ramped surface located on the ceiling surface.

The ratchet wrench may, in an embodiment, be configured for selective operation in a reverse mode. Such a bi-directional wrench further includes: a second ramped surface of the second cavity and a second catch portion of the pawl. Additionally, means are provided, such as an externally mounted lever fixed to the pawl, for switching the pawl position so that the biasing mechanism is on the second ramped surface. When in the reverse mode, the pawl is rotatably movable to a second engaged position such that the second catch portion engages at least one of the teeth of the gear portion to prevent the gear portion from rotating in the second direction. The pawl is rotatable away from the engaged position to permit rotation of the gear portion in the first direction opposite the second direction. The biasing mechanism urges the contact toward the second ramped surface when the ratchet mechanism is in the reverse mode, and the contact is movable along the second ramped surface to rotationally bias the pawl toward the second engaged position.

In the reversible, bi-directional embodiment of the ratchet mechanism, the first and second ramped surfaces generally follow curved paths along the same circumference. Moreover, the first and second ramped surfaces are separated by a ridge, wherein the first and second ramped surfaces slope downwardly away from each other from the ridge. When the pawl is reversibly switched between rotational modes, the pawl must be rotated with sufficient force to overcome a resistance of the biasing mechanism to "click over" the ridge as the contact of the biasing mechanism moves from the first ramped surface to the second ramped surface, and vice versa.

Within the second cavity, at least one ramped surface is included in the case. In an embodiment, one ramped surface is milled into the floor of the case and is positioned such that the bore in the pawl registers with the ramped surface on the floor of the case when the pawl is moved toward the engaged position wherein the pawl engages one or more of the teeth of the main gear. The contact ball bearings of the biasing mechanism will be urged by the pressure created by the coil spring to travel down the ramped surface to position the pawl in the engaged position. In a bi-directional embodiment, there are two ramped surfaces on the floor of the second cavity, allowing for the biasing mechanism to be positioned in an engaged position registering with one or the other ramped surfaces. In embodiments including two ramped surfaces on one surface of the case, the ramped surfaces slope upward to meet at a ridge and slope downward away from one another.

In still yet other embodiments, there may be one or more ramped surfaces on both the floor and ceiling of the case that are mirror images of one another and will each be in contact with the biasing mechanism when the pawl is in an engaged position. In embodiments involving ramped surfaces on the ceiling of the case, the ball bearing, or contact, on the top surface of the pawl is urged by the spring to follow the path down the ramped surface in the ceiling of the case, tending thereby to hold the pawl in the desired position. The ramped surface or surfaces in the ceiling of the case and the ball bearing nearest the top surface of the pawl act in concert with the ball bearing, or contact, nearest the bottom surface of the pawl and the ramped surface or surfaces in the floor of the case to ensure that the pawl remains in the desired position.

In another embodiment, a throat extension is formed integrally with and as a part of the case and a mounting aperture is formed therethrough to allow the head to be attached, for example, to a wrench handle or a torque wrench body.

It is an advantage of the present invention to provide a ratchet head of greatly simplified construction which can readily be adapted for use with reversible ratchet wrenches as well as reversible and unidirectional torque wrenches. For example, embodiments of the present invention are made with fewer and less complicated machining steps than the conventional ratchets. In particular, the present invention avoids a need to drill a bore into the case to receive a spring that acts on the pawl. The present invention also avoids a need to shape the portion of the pawl nearest the handle of the wrench into a special contour. In an embodiment of the present invention, a bore is drilled instead through the pawl, a drilling process that is easier, less labor intensive and less costly than drilling a bore in the case or handle, as in conventional ratchet wrenches.

Another advantage of the present invention is that it provides a ratchet mechanism with a simplified pawl construction including means for retaining the pawl in a selected position while allowing the ratchet to rotate freely in a first direction while locking it in, preventing it from rotating in the opposite direction. In the present invention, the construction of the pawl does not require the expensive and labor-intensive machining required to shape the contour of the pawl in a conventional ratchet.

A still further advantage of the present invention is that it permits for the manufacture of cases for said ratchet heads in which the machining operations required to construct and form the cases are simple and straightforward in nature. The conventional ratchets require special tools for machining because of the bore that must be drilled into the case or handle of the ratchet. The present invention overcomes this disadvantage by drilling a bore through the pawl instead, a more simple machining operation.

Still further, an advantage of the present invention is that it provides ratchet heads and configurations with optimal strength, particularly at a location where the case is mounted to a ratchet handle or a torque wrench body. Conventional ratchets sacrifice strength in the body or handle of the ratchet as a result of the blind bore required to accommodate a conventional pawl biasing member. The blind bore weakens the area in a conventional ratchet that is subject to significant stress. The present invention leaves the case and handle of the ratchet intact, avoiding such weakened hollow spots required by conventional wrenches.

It is a further advantage of the present invention to provide ratchet mechanisms assembled from few parts with easy assembly.

BRIEF DESCRIPTION OF THE DRAWINGS

These and other aspects of the present invention will become more apparent upon a consideration of the accompanying drawings in which.

DETAILED DESCRIPTION OF THE INVENTION

Figure 1:
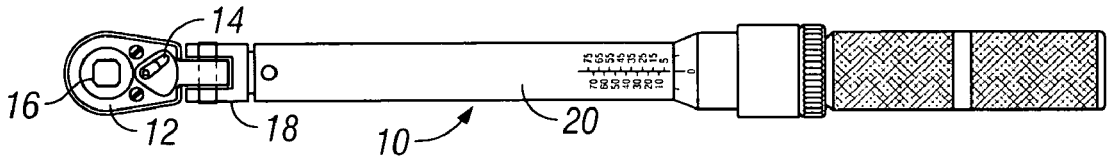
FIG. 1 (Prior Art)
FIG. 1 is a plan view of a conventional wrench including a ratchet head pivotally mounted to a torque wrench body.
Figure 2:
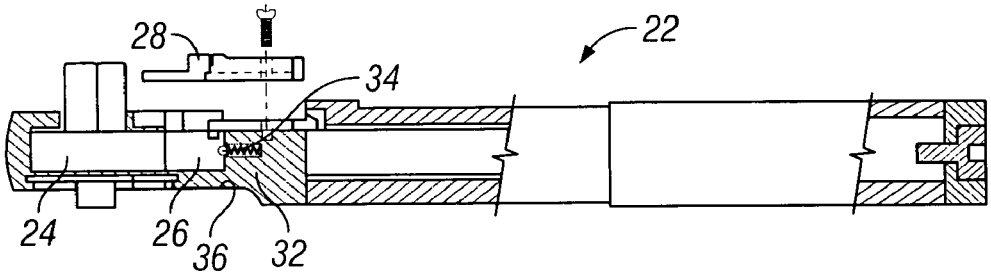
FIG. 2 (Prior Art)
FIG. 2 is a schematic, side, sectional view of a conventional ratchet wrench, the cutaway showing a conventional biasing mechanism.
Figure 3:
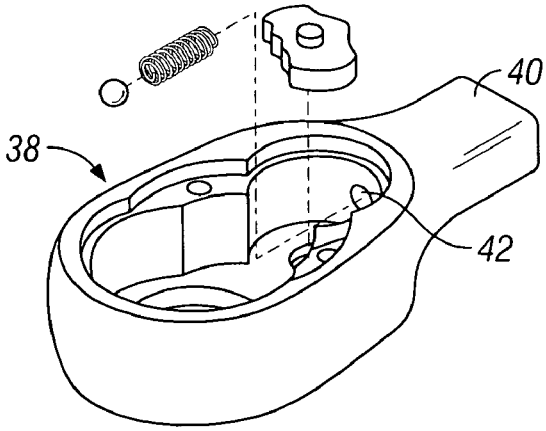
FIG. 3 (Prior Art)
FIG. 3 is an exploded, perspective view of the components of a ratchet head, showing a conventional pawl and associated biasing mechanism that seats in a blind bore extending into the case, radially away from the pawl.

Referring now to the drawings, wherein like numerals designate like components, FIGS. 1–3 illustrate a wrench 10 having a conventional ratchet mechanism. Generally, the wrench 10 includes a ratchet head 12 with a reversing or selection lever 14, movable from a first to a second position. When the selection lever 14 is in the first position, a drive stud 16 will freely rotate ("freewheel") in a first direction but is prevented from turning in the opposite direction. When lever 14 is in the second position, the rotation of stud 16 is reversed. The head 12 is joined at throat 18 to a handle or torque wrench body 20.

As illustrated in FIG. 2, a conventional reversible ratchet wrench 22 has a main gear 24 and a pawl 26 to which a ratchet switch 28 is attached. As with the foregoing description, switch 28 is movable from a first to a second position, whereby each position is operable to position the pawl for engaging the main gear 24 to permit a respective direction of rotation of the main gear. A blind bore 32 is formed in wrench 22 in a direction generally radially away from the pawl and axially with respect to the handle. Seated in the bore 32 is a conventional biasing mechanism, specifically including a spring biased ball 34 and a biasing spring 36. The pressure of ball 34 against pawl 26 urges the pawl 26 toward an engaged position associated with the selected direction of rotation as set by the position of the switch 28.

Another conventional ratchet head 38 is illustrated in FIG. 3, wherein the head includes a throat 40 into which a blind bore 42 has been machined for the purpose of receiving a biasing spring and ball.

Turning to FIGS. 4–6, 7A, 7B, and 23, an exemplary ratchet head 44 is shown. The ratchet head 44 includes a case having a main portion 46 and a cover plate 48. The main portion 46 is preferably unitary and machined from a single block of steel. The cover plate 48 is secured to the main portion 46 in an appropriate manner, such as by screws 52. A drive member 50 protrudes through the cover plate 48. Drive member 50 is of conventional construction well known in the art and is suited for the attachment of sockets and other attachments of various sizes and configurations.

The main portion 46 of the case also includes an extension or throat 54 which provides an attachment site for a wrench handle or torque wrench body (such as the wrench handle 20 of FIG. 1). The throat may have a mounting aperture 62 that extends transversely therethrough for pivotally mounting the handle or torque wrench body. Alternatively, a handle may be integrally formed with the throat, as will be recognized by those of ordinary skill in the art. Details of the construction of the exemplary head 44 are set forth below.

Figure 8:
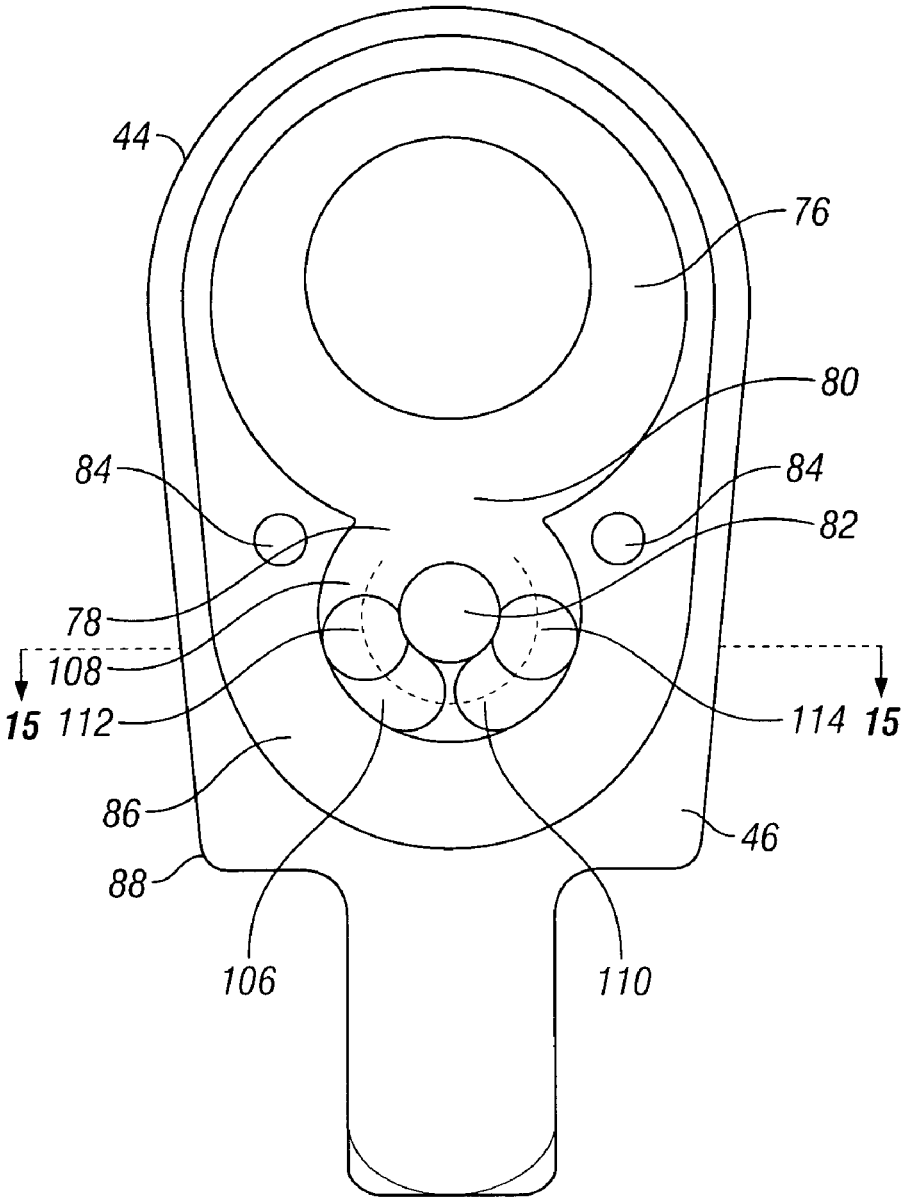
FIG. 8 is a plan view of the ratchet case of the ratchet head of FIG. 4.
Figure 16:
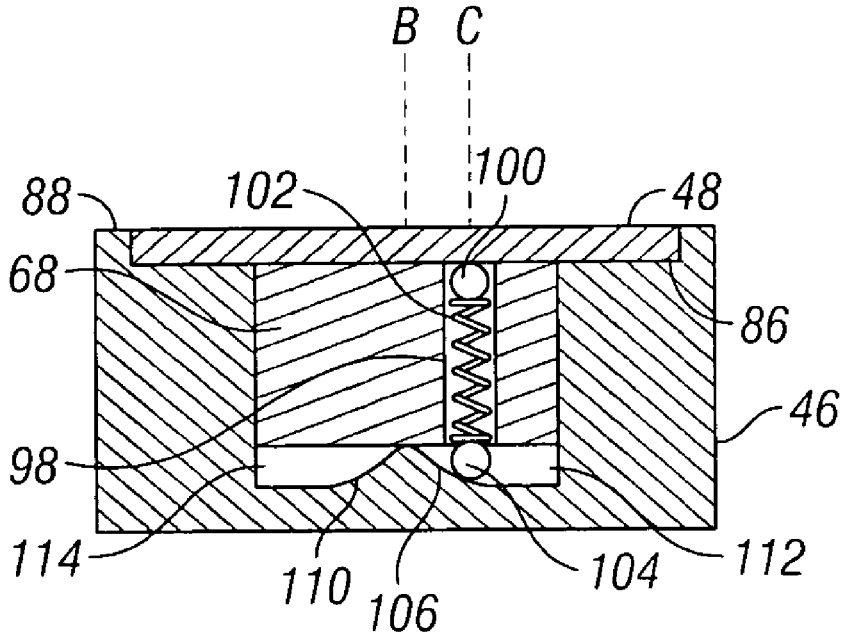
FIG. 16 is a sectional view taken generally along line 16—16 of FIG. 7A.

As shown in FIGS. 8 and 16, main portion 46 of the case is preferably machined to form a face 86 which extends beneath or below front case surface 88 and which is sized to closely fit cover plate 48. The portion of face 86 extending about the periphery of cavity 76 forms a flange 90 and thereby cover plate 48 of the case is supported about its entire periphery when assembled to main portion 46 of the case.

Figure 4:
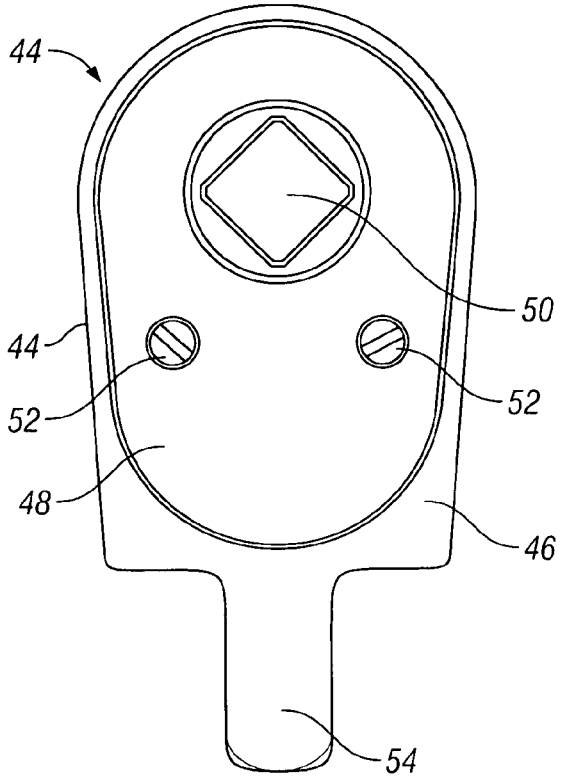
FIG. 4 is a plan view of a ratchet head having features according to teachings of the present invention.
Figure 5:
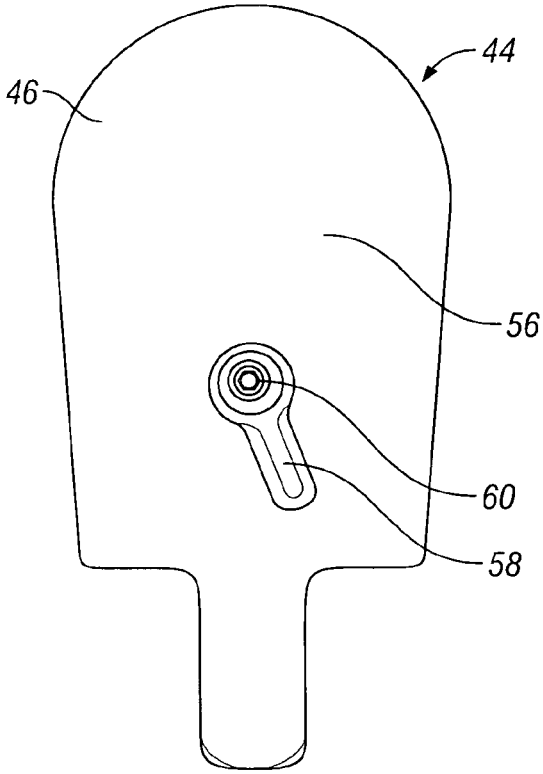
FIG. 5 is a base view of the ratchet head of FIG. 4.
Figure 6:
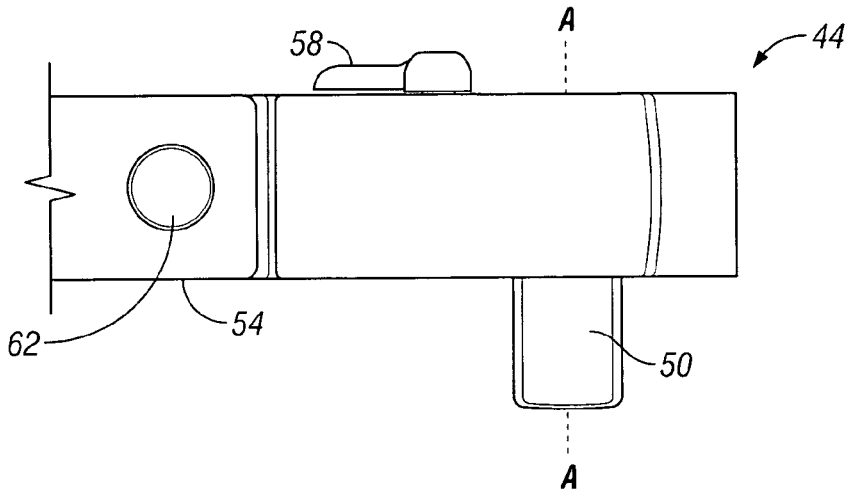
FIG. 6 is a side elevation of the ratchet head of FIG. 4.

The ratchet head 44 illustrated in FIGS. 4–6, 7A, 7B, and 23 is of a type operable for selective bi-directional ratchet operation. Accordingly, as shown in FIGS. 4 and 6, the head 44 includes a selection or reversing lever 58 that is movable between two positions to respectively facilitate one-way rotational motion of the drive member 50 in either a clockwise or counterclockwise direction about axis A (FIG. 6). The reversing lever 58 is mounted via a screw 60, shown in FIG. 5, to fix the reversing lever 58 to a pawl that resides within the case 46, 48, as will be described in greater detail below. The reversing lever 58 may be located at a side of the ratchet head opposite the drive member 50, as illustrated in FIG. 6, however, those of ordinary skill in the art will recognize that structures other than the lever 58 in the may be suitable for affecting a reversing action. As will be understood, non-reversing ratchets mechanisms capable of unidirectional ratchet operation are also possible, as will be described further below in connection with FIGS. 17–21.

Figure 7A:
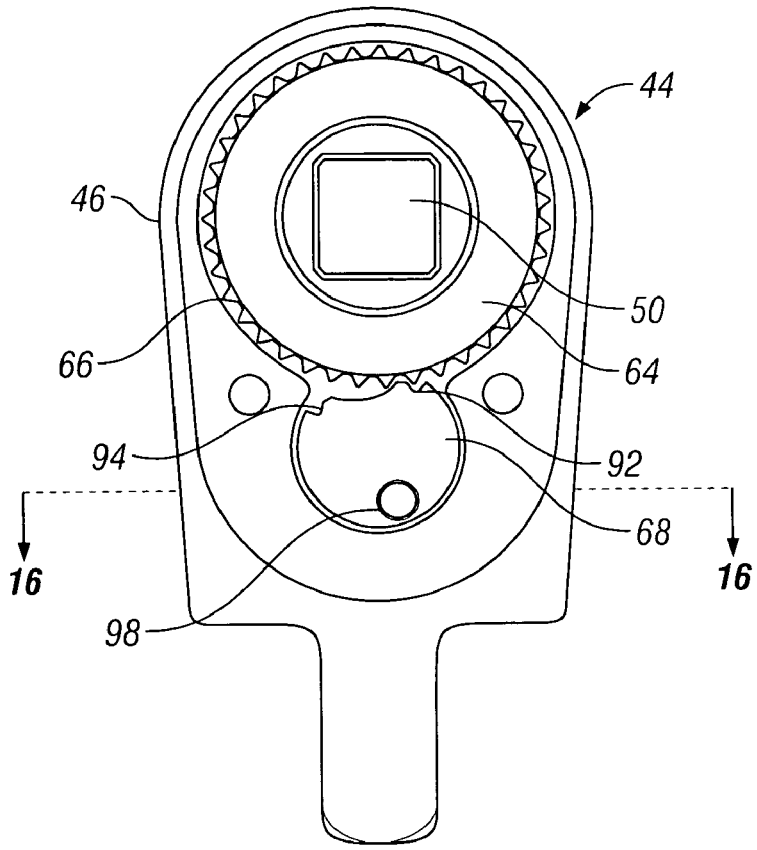
FIG. 7A is a plan view of the ratchet head of FIG. 4 with the cover plate, or ceiling of the case, removed to show exemplary components including the main gear, pawl, and biasing mechanism.
Figure 7B:
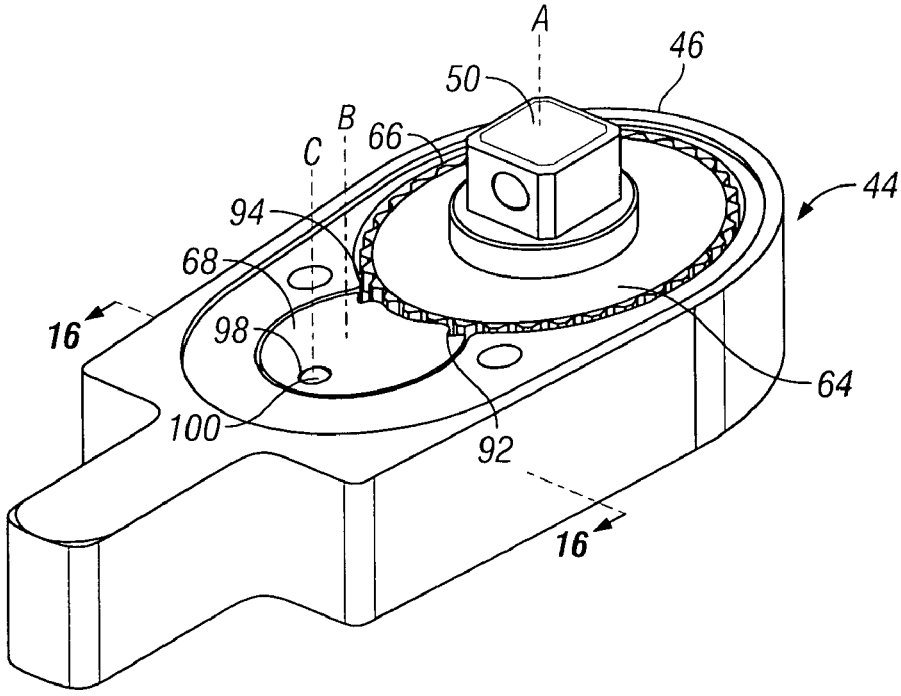
FIG. 7B is a perspective view of the ratchet head of FIG. 4 with the cover plate removed, showing rotational axes of the pawl and main gear, and an alignment axis of the biasing mechanism.

Still referring to the ratchet head 44, FIGS. 7A and 7B illustrate the ratchet head 44 wherein the cover plate 48 and case screws 52 (FIG. 4) have been removed. The main portion of the case 46, as shown isolated in FIG. 8, includes a first cavity 76 and a second cavity 78. The cavities 76, 78 are open to each other in a contiguous fashion to overlap at a waist 80. Moreover, each of the first and second cavities is preferably generally cylindrical in shape. The first and second cavities 76, 78 are enclosed within the case. For example, the second cavity is defined by a floor of the main portion 46 of the case, a cylindrical sidewall extending upwardly from the floor, and a ceiling formed by an inner surface of the cover plate 48.

Figure 12:
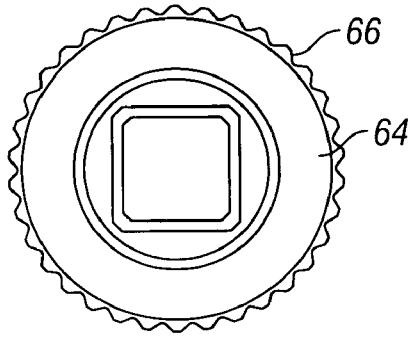
FIG. 12 is a plan view of the main gear as used in the ratchet head of FIGS. 7A and 7B.
Figure 13:
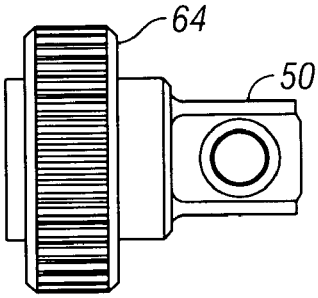
FIG. 13 is a side elevation of the main gear of FIG. 12.
Figure 14:
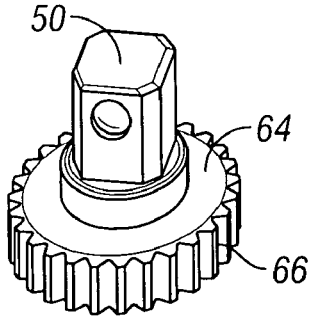
FIG. 14 is a perspective view of the main gear of FIG. 12.

As illustrated in FIGS. 7A, 7B, a main gear 64 resides in the first cavity 76 (FIG. 8). The main gear 64 is rotatable with respect to the case about axis A indicated in FIGS. 6 and 7B. The first cavity 76 has a size and shape to closely receive the main gear 64 with sufficient tolerance to permit free rotation of main gear 64. Details of the main gear 64 are best illustrated in FIGS. 12–14. The main gear 64 includes a circular gear portion having a plurality of teeth 66 located around the periphery or outer circumference. The ratchet teeth 66 are preferably formed with a generally V-shaped profile, but those of ordinary skill in the art will recognize that the teeth 66 may have various shapes and configurations. The drive member 50 is preferably integral with the circular gear portion and projects centrally therefrom. As seen in FIG. 7A, the overlap between the first and second cavities 76, 78 allows a portion of main gear 64 to extend into the second cavity 78.

Furthermore, as shown in FIGS. 7A, 7B, a pawl 68 resides in the second cavity 78. The second cylindrical cavity 78 has a size and shape to closely receive pawl 68 with sufficient tolerance to permit free rotation of the pawl about axis B (FIG. 7B). Details of the pawl 68 are best illustrated in FIGS. 9–11.

According to an aspect of the invention, a biasing mechanism is housed in, and carried by, the pawl. The biasing mechanism is operable to exert a bias force outwardly from the pawl against one or more ramped surfaces of the case. A reaction force has a component that exerts a rotational moment on the pawl, thereby biasing the pawl to rotate in a desired direction. For example, the pawl may include a bore that is parallel to, and offset from, an axis of rotation of the pawl with respect to the case. The biasing mechanism may include a coil spring housed within the bore in compression between a pair of contact balls. The spring presses each of the contact balls axially outwardly from a top and bottom of the pawl respectively against a ceiling and floor of the case. The ramped surface is positioned to provide a bearing path for one of the contact balls. At least one ramped surface is provided, and in one variation, dual ramped surfaces can be provided at opposite sides of the cavity so that each of the contact balls of the biasing member is acting upon a respective ramped surface to impart a moment to the pawl. Moreover, the pawl and ramped surfaces can be configured for a unidirectional ratchet operation of the main gear in a fixed rotational direction or bi-directional ratchet operation of the main gear selectively in one of two rotational directions.

Figure 9:
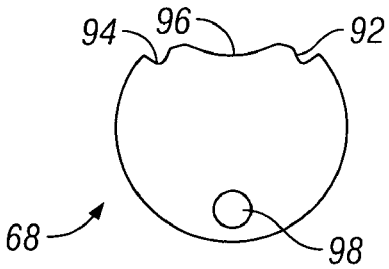
FIG. 9 is a plan view of an exemplary pawl, as used in the ratchet head of FIGS. 7A and 7B, wherein the pawl is configured for selective bi-directional ratchet operation.
Figure 10:
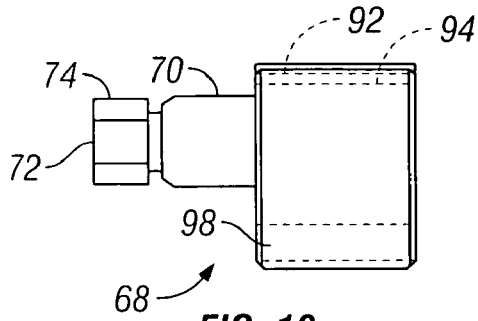
FIG. 10 is a side elevation of the pawl of FIG. 9.
Figure 11:
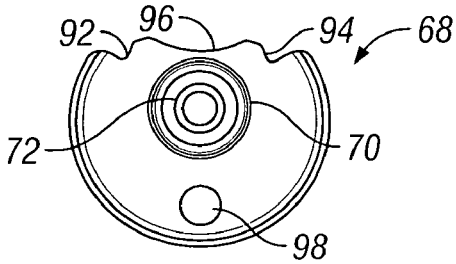
FIG. 11 is a base view of the pawl of FIG. 9.
Figure 23:
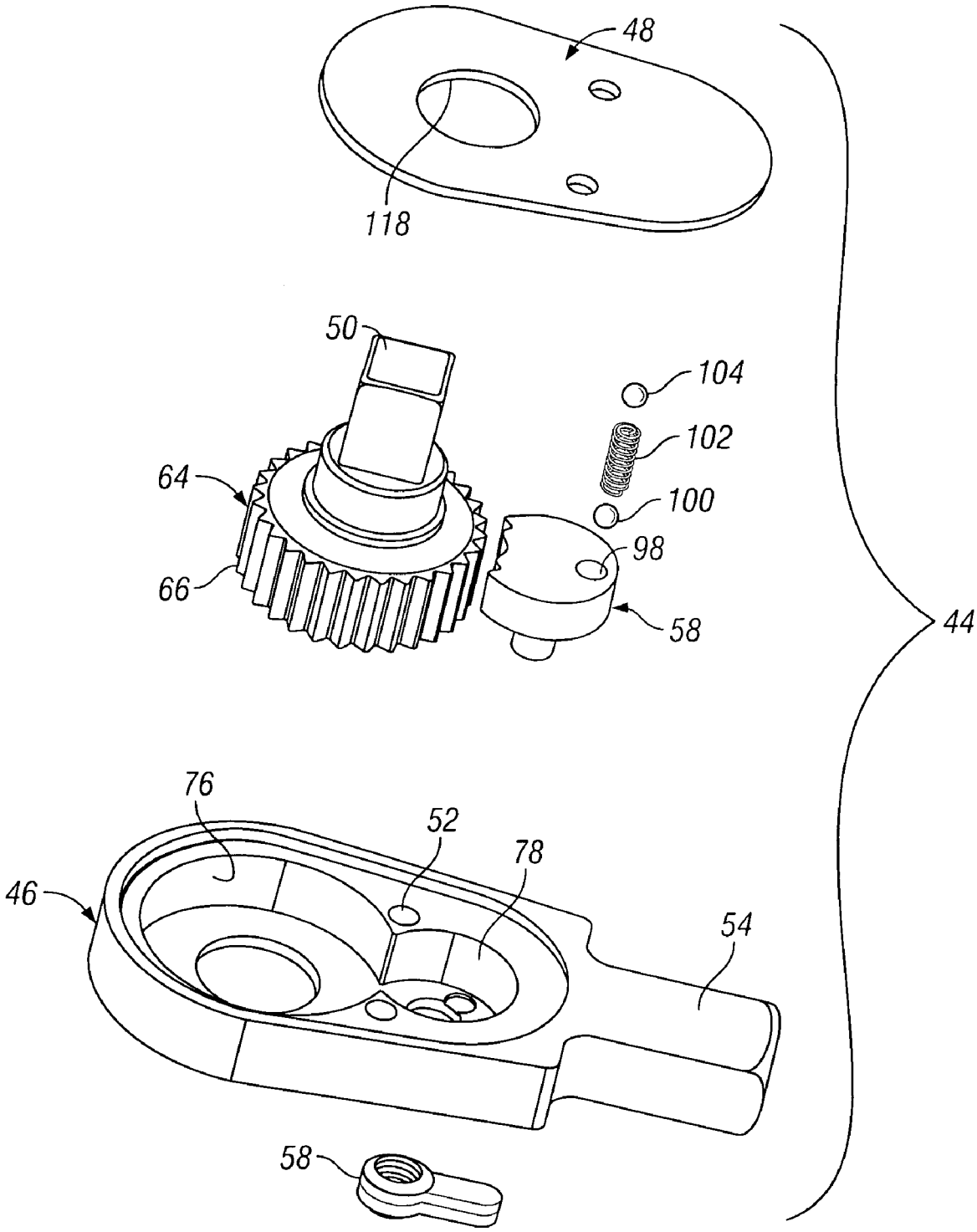
FIG. 23 is an exploded, perspective view of the ratchet head of FIGS. 7A and 7B.

For example, as shown FIGS. 9–11, the pawl 68 includes a bore 98. The bore 98 preferably extends transversely through the pawl 68 along an axis C that is parallel to a central axis B of the pawl in an offset manner. A biasing mechanism, which includes, for example, a coil spring 102 and upper and lower contact balls 100, 104, illustrated in FIG. 23, is housed within the bore 98. The coil spring 102 has opposed ends held in compression within the bore 98 between the upper and lower contact balls 100, 104. Accordingly, the spring 102 is selected to have a length such that it must be compressed to allow balls 100 and 104 to be inserted into the bore 98. A portion of each of the contact balls 100, 104 may project from the bore 98 to contact the adjacent cavity surfaces. The biasing mechanism is effectively captured between the floor and ceiling of the second cavity. The outward energy of the biasing mechanism is translated into a rotational moment on the pawl by acting on one or more ramped surfaces, which will be described below in greater detail. The pawl 68, biasing member, and ramped surfaces are designed to urge the pawl to rotate toward an engagement with the main gear so as to yield a desired ratchet action.

In order to prevent rotation of the main gear 64 in a particular direction, the pawl 68 is movable to at least a first engaged position in which the pawl engages the main gear 64 to prevent rotation of the main gear relative to the case 46, 48. The features of the pawl 68 are best illustrated in FIGS. 9–11. The pawl 68 is shown as having a generally cylindrical body with a generally circular profile. Because pawl 68 is an example of a pawl useful for bi-directional ratchet operation, a portion of the pawl 68 is milled away to form a first catch portion 92 and a second catch portion 94 that are generally symmetrical to each other. Each of the catch portions preferably includes a notch or channel shaped to cooperatively receive one of the teeth 66 of the main gear 64. An arcuate cutout forms a concave surface 96 that extends between the first and second catch portions 92 and 94. The concave surface 96 provides clearance for the main gear 64.

Referring again to FIG. 7A, the pawl 68 is shown in a first engaged position wherein the first catch portion 92 is engaged with the ratchet teeth 66 of main gear 64. In the first engaged position, the catch portion 92 prevents the main gear 64 from rotating in a clockwise direction with respect to FIG. 7A. The pawl 68 may also be moved to a second engaged position wherein the second catch portion 94 is engaged with teeth 66 of the main gear 64. In the second position, the second catch portion 94 prevents the main gear from rotating in a counterclockwise direction with respect to FIG. 7A. The interengagement of catch portions 92 and 94 with teeth 66 will be understood by those skilled in the art.

The biasing mechanism applies a rotational moment to the pawl to provide bias selectively toward either the first engaged position or second engaged position. As a result, the pawl 68 may be deflected away from either the first or second engaged position, clearing away from the teeth 66 of the main gear 64 to provide freewheeling of the main gear in a direction opposite to the selected engagement direction. For example, when the pawl 68 is in the first engaged position so as to prevent the main gear 64 from rotating clockwise, the main gear 64 may be rotated counterclockwise provided that the rotational bias force on the pawl is overcome. It will be appreciated that such operation is provided in the opposite direction when the pawl 68 is in the second engaged position.

According to an aspect of the invention, at least one ramped surface is provided in order to create a rotational bias on the pawl. The ramped surface is positioned along a contact path of the biasing member corresponding to rotation of the pawl. Such a ramped surface may be formed on the ceiling or floor of the second cavity, or in an embodiment, and opposed ramped surfaces may be provided on both the ceiling and floor to provide a dual action. In a bi-directional embodiment, first and second ramped surfaces are provided that slope in opposite directions to selectively provide a reversible bias force.

Figure 8A:
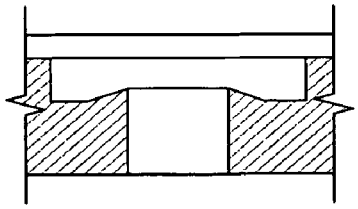
FIG. 8A is a sectional view as taken generally along line 8A—8A of FIG. 8.
Figure 15:
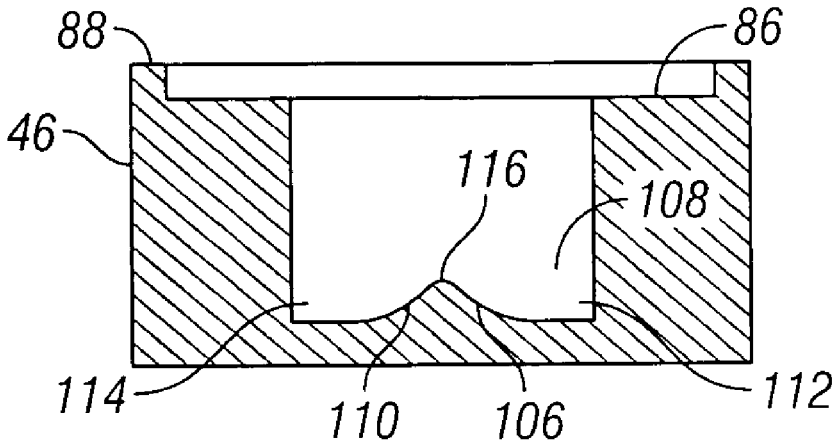
FIG. 15 is a sectional view taken generally along line 15—15 of FIG. 8.

Exemplary ramps 106, 110 are illustrated in FIGS. 8, 8A and 15, which illustrate the main portion 46 of the case with main gear 64 and pawl 68 removed. More particularly, a first ramp 106 is milled into the floor 108 of second cavity 78. A second ramp 110 is similarly milled into floor 108. Ramp 106 terminates at seat 112 while ramp 110 terminates in a seat 114. The first ramp 106 and second ramp 110 slope in opposite directions from one another. As illustrated in FIGS. 8 and 15, ramps 106 and 110 are separated by a ridge 116. The first ramp 106 slopes downwardly from ridge 116 toward seat 112 while second ramp 110 slopes downward from ridge 116 toward seat 114. As can be seen in the plan view of FIG. 8, the ramps are shaped along a generally circular path followed by the biasing member as the pawl rotates.

As illustrated in FIG. 16, when pawl 68 is in the position shown, the spring 102 is compressed between the lower contact ball 104 and the upper contact ball 104. Accordingly, the spring 102 urges the upper contact ball 100 and lower contact ball 104 linearly away from each other along axis C, in particular urging the upper contact ball 100 into contact against the ceiling defined by the cover plate 48 and urging the lower contact ball 100 into contact against the first ramped surface 106 on the floor 108 of the main portion 46 of the case. Portions of the contact balls 100, 104 may extend outwardly from the bore as necessary to remain in contact between the floor and ceiling of the second cavity.

Because the first ramped surface 106 has an inclined shape, the first ramped surface 106 imparts a reaction force to the lower contact ball 104 that has a force component perpendicular to axis C that is effective to create a moment on the pawl 68. The spring 102 tends to cause the lower contact ball 104 to move downwardly on the ramp 106, thereby biasing the pawl to rotate in a corresponding direction toward the first engaged position with respect to the main gear as described in connection with FIG. 7A. It will be appreciated that when the pawl 68 is rotationally positioned so that the lower contact ball 104 is in contact with the second ramped surface 110, a similar biasing force will occur in a reversed direction to rotationally bias the pawl toward the second engaged position with respect to the main gear.

Still referring to FIG. 16, the pawl 68 can be deflected away from the first engaged position or the second engaged position, whereby the lower contact ball 104 moves upwardly along the first ramped surface 106 or second ramped surface 110 toward the ridge 116, thereby compressing the spring 102. When main gear 64 is turned to freewheel, pawl 68 has a tendency to turn in a direction which forces ball 104 along ramp 110 toward ridge 116. When force is applied to ratchet 44 to again lock main gear 64 against pawl 68, spring 102 forces lower retaining ball 104 against ramp 110 and tends to force it down along ramp 110 toward ramp bottom 114.

Figure 22:
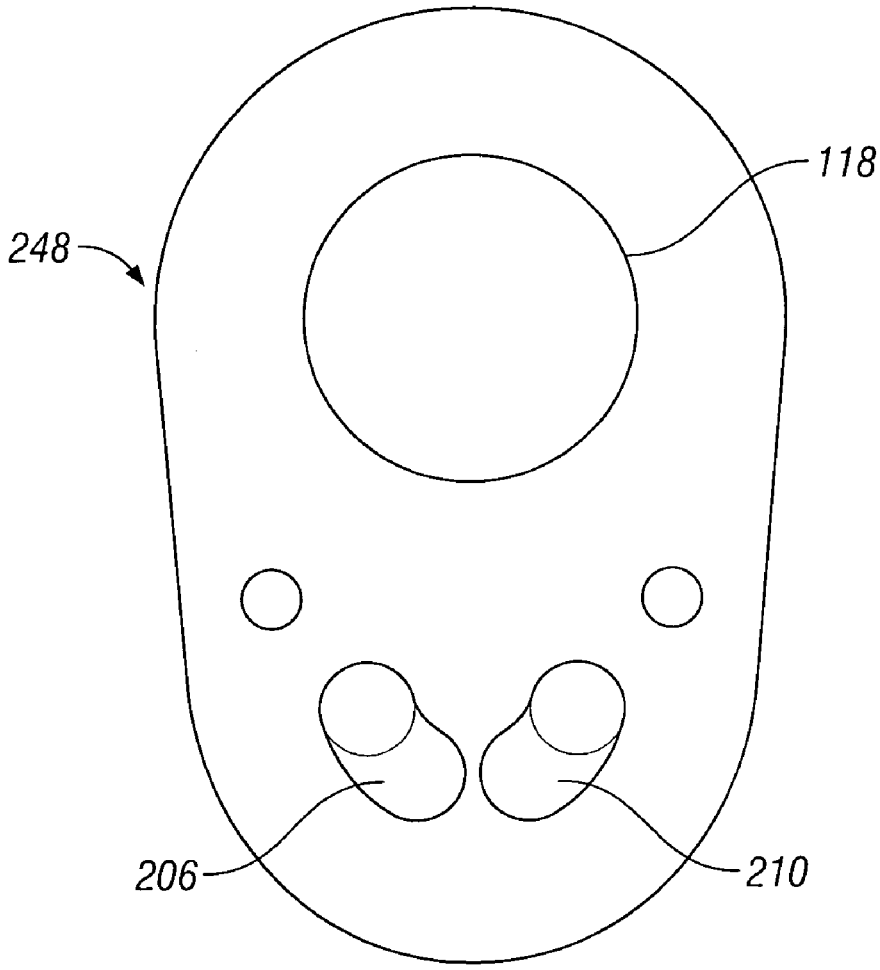
FIG. 22 is a base view of the cover plate, which forms the ceiling of the case, wherein the cover plate includes ramped surfaces positioned for contact by the biasing mechanism.

Other ramp configurations may also be used as situations and use requirements dictate. For example, the present invention also includes embodiments wherein one or more ramped surfaces are provided on the ceiling of the cavity. A cover plate 248 is illustrated in FIG. 22 that has first and second ramped surfaces 206, 210, respectively. The first and second ramped surfaces 206, 210 in the cover plate are configured to contact against the upper contact ball 100 of the biasing mechanism and are thereby effective to impart a rotational bias to the pawl in a manner similar to that described in connection to FIG. 16 with the ramped surfaces formed at the floor. The ramped surfaces 206, 210 in the cover plate 248 may be used either as an alternative to, or in combination with, the ramped surfaces 106, 110 in the main portion 46 of the case. Combined use of like-shaped ramps results in a doubling of the bias force action that would be yielded by a ramped surface at only the floor or ceiling.

To facilitate selective reversal of the ratchet direction in the bi-directional embodiment, the pawl 68 is configured to be securable to the reversing lever 58 (FIGS. 5, 6). The pawl 68 illustrated in FIGS. 10–11 includes an integral extension 70 that extends through the case so that the reversing lever 58 can be mounted thereon. The extension 70 has a hex-shaped nub 74 that is cooperatively received by the lever 58. The lever 58 is secured to the pawl extension 70 by a mounting screw 60 threaded into an aperture 72 in the extension 70. It will be understood that the extension and lever described herein are exemplary, and that other structures may be possible.

By moving the reversing lever 58, the pawl 68 is forced to rotate within the second cavity 78. When a force is applied to the reversing lever sufficient to overcome an internal resistance of the biasing member, the pawl 68 may be switched to reverse the direction of selected ratchet rotation. In particular, when such a force is applied to the lever 58, rotation of the pawl 68 changes the position the biasing member with respect to the adjacent ramped surface, thereby compressing the biasing member until it clears and "clicks over" a the ridge 116 between the first ramped surface 106 and the second ramped surface 110, and vice versa, reversing the direction of rotational bias on the pawl.

Also as seen in FIG. 8, second cavity 78 has a case aperture 82 formed therethrough. When assembled, pawl extension 70 extends through case aperture 82 and pawl 68 is secured to case 46 by the attachment of reversing lever 58 to nub 74 of pawl extension 70 as illustrated in FIG. 6. A pair of tapped holes 84 are formed in case 46 to receive case screws 52 and to thereby secure cover plate 48 to case 46.

The assembly of the ratchet head 44 is relatively uncomplicated. The main gear 64 is placed into the first cavity 76 of the main portion 46 of the case, and the pawl 68 is inserted into second cavity 78 so that the extension 70 extends through case aperture 82. The reversing lever 58 is then mounted to nub 74 with lever screw 60. The lower contact ball 104 is then inserted into the bore 98 in the pawl 68, followed by the spring 102, which is also placed in the bore, and the upper contact ball 100, which is placed on top of the spring 102. The cover 48 is then placed in position so that the drive member 50 extends through the aperture 118. Screws 52 are then threaded into holes 84 to secure the cover plate 48 in place. When the cover plate 48 is secured in place, the spring 102 is compressed between the upper and lower contact balls 100, 104.

The structure of the ratchet head 44 described herein allows for greatly simplified assembly because it avoids a need to perform the time consuming and awkward machining of the blind bore (e.g., element 32 in FIGS. 2 and 42 in FIG. 3) in conventional ratchets. Rather, the bore 98 is easily formed as a straight through boring operation. The elimination of the conventional blind bore increases strength of the ratchet case, which is particularly important when ratchet head 44 is used as a part of a torque wrench.

Figure 17:
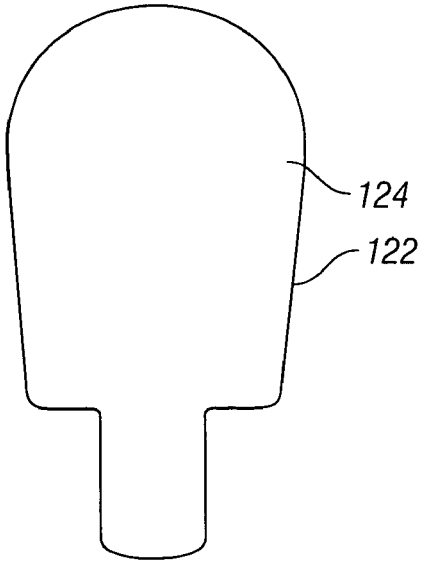
FIG. 17 is a base view of the ratchet head of FIG. 18.
Figure 18:
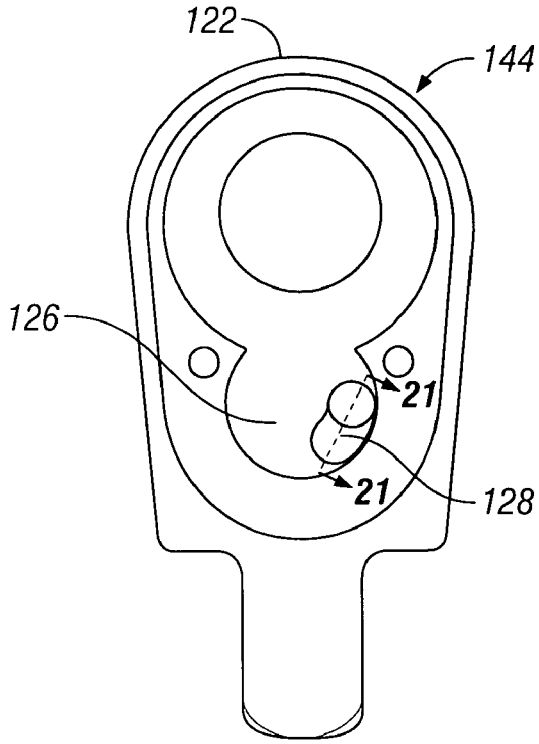
FIG. 18 is a plan view of the ratchet head of FIG. 17, showing a ramp formed in the case that is operable for unidirectional ratchet operation.

The present invention may also be used in a non-reversible, unidirectional ratchet head. For example, a unidirectional ratchet head 144 is illustrated in FIGS. 17–21. Such a ratchet head 144 may be used, for example, in use with a torque wrench where it is desirable to have the wrench operate in a tightening direction only to avoid damage to the wrench from a reversed torque. As shown in FIGS. 17, 18 and 20, the ratchet 144 includes a case having a main portion 122 and a cover plate (e.g., the cover plate 48 described herein in connection with FIGS. 4 and 16). The main portion 122 of the case may have a solid back 124, with no aperture required for attachment of a reversing lever to the pawl. As shown by FIG. 18, a pawl cavity 126 includes a single ramp 128 that is formed in a floor thereof. It will be appreciated that a ramp could be alternatively or additionally provided in the cover plate.

Figure 19:
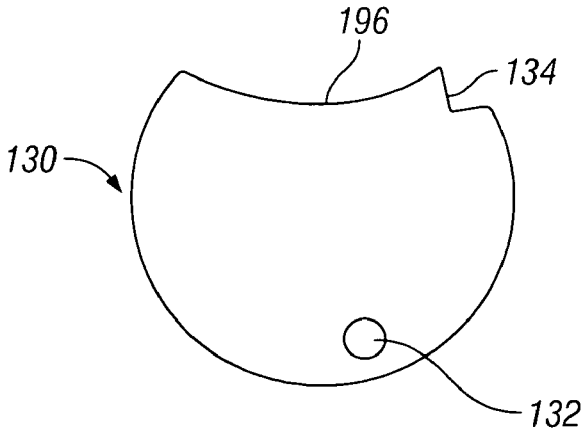
FIG. 19 is a plan view of an embodiment of the pawl useful for unidirectional ratchet operation.
Figure 20:
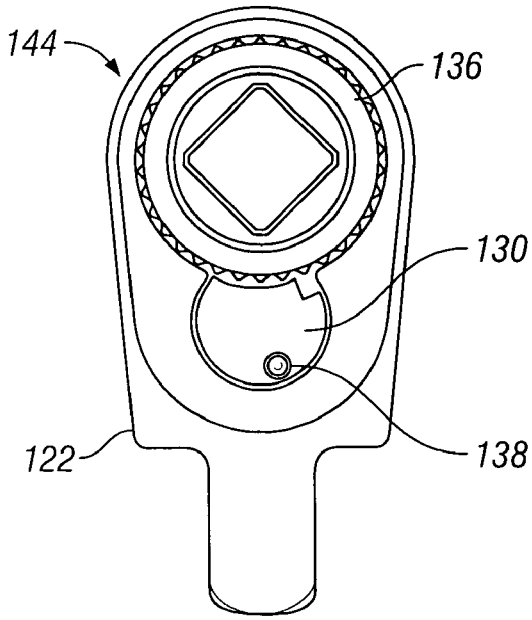
FIG. 20 is a plan view of the case of FIG. 18 with the pawl, main gear, and biasing mechanism assembled.
Figure 21:
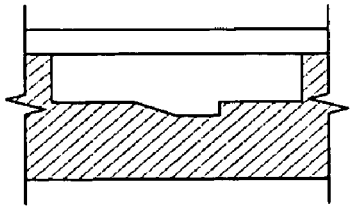
FIG. 21 is a sectional view as taken generally along line 21—21 of FIG. 18.

The unidirectional ratchet head 144 includes a pawl 130 as illustrated in FIGS. 19 and 20. The pawl 130 is generally cylindrical in shape. The pawl 130 includes a cut away portion shaped to provide only a first catch portion 134. The catch portion 134 shaped to engage a tooth of the main gear 136. As illustrated in FIGS. 19 and 20, the pawl includes a bore 132 to contain a biasing mechanism, which may include upper and lower contact balls and a compressed coil spring as described above in connection with the embodiment of FIGS. 4–17 and 23. In FIG. 20 only an upper contact ball 138 is shown, but it will be understood that the unidirectional ratchet operates in a manner similar to the foregoing embodiments so that the biasing mechanism acts on the ramp 128 (FIGS. 18 and 21) to rotationally bias the pawl 130 to an engaged position with the main gear 136 to prevent rotation of the main gear in one direction, and to permit rotational deflection of the pawl 130 away from the engaged position to permit free rotation of the main gear in an opposite direction.

In order to limit the amount of rotational movement the pawl 130 away from the engaged position, the pawl 130 is shaped to have a concave surface 196. The concave surface 196 preferably has a radius about equal to an outer radius of the main gear 136. The concave surface is configured to allow sliding contact against the main gear when the pawl 130 is rotated to a maximum desired angle away from the engaged position, thereby advantageously preventing the contact ball from leaving the ramped surface 128.

While the foregoing describes a preferred embodiment or embodiments of the present invention, it is to be understood that these descriptions are made by way of example only and are not intended to limit the scope of the present invention. It is expected that alterations and further modifications, as well as other and further applications of the principles of the present invention will occur to others skilled in the art to which the invention relates and, while differing from the foregoing, remain within the spirit and scope of the invention as herein described and claimed.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A ratchet mechanism comprising:

a case having a first cavity and a second cavity, the first cavity being contiguous to the second cavity and the second cavity having at least a first ramped surface;

a main gear that rotatably resides in the first cavity, the main gear including a plurality of teeth;

a pawl that rotatably resides in the second cavity, the pawl being shaped to have at least a first catch portion, the pawl being rotatably movable about a pawl axis to at least a first engaged position wherein the first catch portion of the pawl engages at least one of the teeth of the main gear to prevent the main gear from rotating in a first direction and the pawl being rotatable away from the engaged position to permit rotation of the main gear in a second direction opposite the first direction, wherein a bore extends through the pawl along a bore axis that is generally parallel to the pawl axis; and a spring positioned within the bore;

a lower contact ball and an upper contact ball, the lower and upper contact balls being positioned at opposite ends of the spring, holding the spring in compression, whereby the spring urges the contact balls away from each other, at least one of the contact balls being urged into contact with the first ramped surface, and wherein the contact being movable along the first ramped surface to rotationally bias the pawl toward the first engaged position.

2. The ratchet mechanism of claim 1 wherein the case includes a unitary main portion and a cover plate being removably mounted to the main portion to provide access to the first and second cavities.

3. The ratchet mechanism of claim 1 wherein the ratchet mechanism is a ratchet head, whereby the case includes a throat configured to be mounted to a wrench handle.

4. The ratchet mechanism of claim 1 wherein at least a portion of the pawl has a cylindrical shape complementary to a shape of the cavity.

5. The ratchet mechanism of claim 1 wherein the pawl has a concave surface configured to make sliding contact against the main gear operable to limit the rotational movement of the pawl away from the first engaged position.

6. The ratchet mechanism of claim 1, wherein the second cavity includes a floor surface and a ceiling surface, the floor and ceiling surfaces being positioned generally adjacent the top and bottom surfaces of the pawl, respectively.

7. The ratchet mechanism of claim 6, wherein the ramped surface is located on the floor surface of the second cavity.

8. The ratchet mechanism of claim 7 wherein at least another ramped surface is located on the ceiling surface of the second cavity.

9. The ratchet mechanism of claim 8, wherein the lower contact ball is urged toward the at least one ramped surface located on the floor surface, and the upper contact is urged toward the ramped surface located on the ceiling surface.

10. The ratchet mechanism of claim 1, wherein the ratchet mechanism is selectively operable in a reverse mode, the mechanism further comprising:

a second ramped surface of the second cavity; and a second catch portion of the pawl;

an externally accessible lever mounted to the pawl to move the pawl so that a contact ball moves from contact on the first ramped surface to the second ramped surface;

wherein in the reverse mode the pawl is rotatably movable to a second engaged position such that the second catch portion engages at least one of the teeth of the main gear to prevent the main gear from rotating in the second direction and the pawl being rotatable away from the engaged position to permit rotation of the gear portion in the first direction opposite the second direction; and wherein the spring urges at least one of the contact balls toward the second ramped surface, the contact ball being movable along the second ramped surface, thereby rotationally biasing the pawl toward the second engaged position.

11. The ratchet mechanism of claim 10, wherein the first and second ramped surfaces define contact paths along the same circumference, separated by a ridge.

12. The ratchet mechanism of claim 11, wherein each of the first and second ramped surfaces slope downwardly away from the ridge.

* * * * *